US008647217B2

(12) United States Patent
Nishio

(10) Patent No.: US 8,647,217 B2
(45) Date of Patent: Feb. 11, 2014

(54) GOLF CLUB HEAD

(75) Inventor: Masayoshi Nishio, Kobe (JP)

(73) Assignee: SRI Sports Limited, Kobe (JP)

( * ) Notice: Subject to any disclaimer, the term of this patent is extended or adjusted under 35 U.S.C. 154(b) by 37 days.

(21) Appl. No.: 13/480,531

(22) Filed: May 25, 2012

(65) Prior Publication Data

US 2012/0302368 A1 Nov. 29, 2012

(30) Foreign Application Priority Data

May 27, 2011 (JP) ..... 2011-119507

(51) Int. Cl.
*A63B 53/04* (2006.01)

(52) U.S. Cl.
USPC ..... 473/342; 473/345; 473/346; 473/349

(58) Field of Classification Search
USPC ..... 473/324–350, 287–292
See application file for complete search history.

(56) References Cited

U.S. PATENT DOCUMENTS

| | | | | |
|---|---|---|---|---|
| 6,319,149 | B1 * | 11/2001 | Lee | 473/342 |
| 6,572,491 | B2 * | 6/2003 | Hasebe et al. | 473/349 |
| 7,303,488 | B2 * | 12/2007 | Kakiuchi et al. | 473/346 |
| 7,377,861 | B2 * | 5/2008 | Tateno et al. | 473/345 |
| 7,431,668 | B2 * | 10/2008 | Tateno et al. | 473/346 |
| 7,435,191 | B2 * | 10/2008 | Tateno et al. | 473/346 |
| 7,455,597 | B2 * | 11/2008 | Matsunaga | 473/329 |
| 7,955,188 | B2 * | 6/2011 | Bennett et al. | 473/324 |
| 8,182,365 | B2 * | 5/2012 | Wada et al. | 473/344 |
| 2003/0236133 | A1 | 12/2003 | Shimazaki et al. | |
| 2004/0009830 | A1 * | 1/2004 | Nishio | 473/345 |
| 2005/0090333 | A1 | 4/2005 | Shimazaki et al. | |
| 2009/0082135 | A1 | 3/2009 | Evans et al. | |
| 2012/0322580 | A1 * | 12/2012 | Wada et al. | 473/346 |

FOREIGN PATENT DOCUMENTS

JP 2002-052100 A 2/2002

* cited by examiner

*Primary Examiner* — Sebastiano Passaniti
(74) *Attorney, Agent, or Firm* — Birch, Stewart, Kolasch & Birch, LLP

(57) ABSTRACT

A hollow golf club head comprises a main body member provided with a face opening and a sole opening, a face member brazed/soldered to the main body member to close the face opening, and a sole member brazes/soldered/welded to the main body member to close the sole opening. The main body member has a thin front edge part of the sole opening and a thick heat blocking part between the thin front edge part and the face portion. The sole member has a front edge part connected to the sole opening's front edge part and a thicker sole reinforcing part positioned backward thereof. The thicknesses of the sole member's front edge part and the sole opening's front edge part are not less than 0.5 mm and less than 2.5 mm. The thicknesses of the sole reinforcing part and the heat blocking part are 2.5 to 10.0 mm.

20 Claims, 7 Drawing Sheets

GOLF CLUB HEAD

BACKGROUND OF THE INVENTION

The present invention relates to a golf club head increased in the joint strength between a main body member and a face member and sole member and having excellent durability.

In recent years, there has been proposed a golf club head in which a constructional element made of a material different from that of the main body member is used in the sole portion, face portion or the like to improve the position of the center of gravity of the head, a moment of inertia of the head and the like. In order to fix such constructional element to the main body member, brazing, soldering or welding is employed according their materials.

For example, in the case of a golf club head (a) which is as shown in FIG. 7 made up of a main body member (b) provided with a face opening (oa) and a sole opening (ob), a face member (c) fixed to the main body member (b) so as to cover the face opening (oa), and a sole member (d) fixed to the main body member (b) so as to cover the sole opening (ob), a conceivable way to fix the members is to braze or solder the face member (c) to the main body member (b) firstly, and then to weld the sole member (d) to the main body member (b). If the thickness (t) of the sole member (d) is large and the welding requires long time, then the heat during welding transfers to the filler metal (e) fixing the face member (c) to the main body member, therefore, there is a possibility that the joint strength of the face member (c) is decreased. On the other hand, if the thickness (t) of the sole member (d) is decreased to shorten the welding time, then the durability of the sole member (d) and the joint strength of the sole member (d) decrease.

SUMMARY OF THE INVENTION

It is therefore, an object of the present invention to provide a golf club head in which it is possible to improve the joint strength between a main body member and a face member and the joint strength between the main body member and a sole member.

According to the present invention, a golf club head has a hollow structure and has a face portion provided in its front surface with a club face for hitting a ball and a sole portion extending to a lower edge of the face portion and forming a bottom surface of the head, and the golf club head is composed of a main body member separately provided with a face opening opened in the face portion and a sole opening opened in its sole portion side, a face member fixed to the main body member by brazing or soldering so as to close the face opening, and a sole member fixed to the main body member by brazing, soldering or welding so as to close the sole opening, the main body member comprises a sole opening's front edge part forming a part extending from a front edge of the sole opening toward the face portion, and a heat blocking part forming a part between the sole opening's front edge part and the face portion and having a thickness larger than a thickness of the sole opening's front edge part, the sole member comprises a sole member's front edge part connected to the sole opening's front edge part and forming a face-side part of the sole member, and a sole reinforcing part forming a part extending from the sole member's front edge part toward the back face side of the head and having a thickness larger than a thickness of the sole member's front edge part, the thickness of the sole member's front edge part and the thickness of the sole opening's front edge part are not less than 0.5 mm and less than 2.5 mm, and the thickness of the sole reinforcing part and the thickness of the heat blocking part are 2.5 to 10.0 mm.

Further, the golf club head according to the present invention may be provided with the following optional features:

the width of the sole opening's front edge part measured perpendicularly to a longitudinal direction of the sole opening's front edge part is 5.0 to 10.0 mm;

the thickness of the heat blocking part is 1.2 to 8.0 times the thickness of the sole opening's front edge part;

an area of the sole member's front edge part projected on the outer surface of the club head is 10 to 30% of an area of the sole member projected on the outer surface of the club head;

the specific gravity D1 of the main body member, the specific gravity D2 of the face member and the specific gravity D3 of the sole member satisfy the following condition D3>D1>D2;

a length of the sole opening's front edge part measured in a heel-and-toe direction of the head is in a range of from 70 to 90% of a maximum width of the sole member occurring in the heel-and-toe direction;

a length of the heat blocking part measured in the heel-and-toe direction is more than the length of the sole opening's front edge part;

a length of the sole member's front edge part measured in the heel-and-toe direction is substantially equal to the length of the sole opening's front edge part;

a length of the sole reinforcing part measured in the heel-and-toe direction is substantially equal to the length of the sole member's front edge part; and the front edge of the sole opening is curved describing an arc convex toward the face portion, and the sole opening's front edge part, the sole member's front edge part and the sole reinforcing part are also curved therealong.

In the golf club head according to the present invention, therefore, when the face member is fixed to the main body member by brazing or soldering, it is possible to apply a filler metal to the joint portion from the club face side and also from the back side of the face portion through the sole opening. Accordingly, the joint strength between the face member and main body member can be increased.

Further, as the thicknesses of the sole member's front edge part and the sole opening's front edge part are relatively small, it is possible to shorten the time to weld or braze/solder these parts. Accordingly, the heat transfer to the filler metal of the face member can be lessened to avoid degradation of the joint strength by the heat.

Meanwhile, the heat blocking part can increase the strength of the club head and has a relatively large heat capacity, therefore, it is possible to block or lessen the above-mentioned heat transfer to prevent the joint strength from decreasing. Thus, the golf club head according to the present invention is increased in the joint strength between the main body member and the face member and the joint strength between the main body member and the sole member, and the durability can be improved.

DESCRIPTION OF THE PREFERRED EMBODIMENTS

Figure 1:
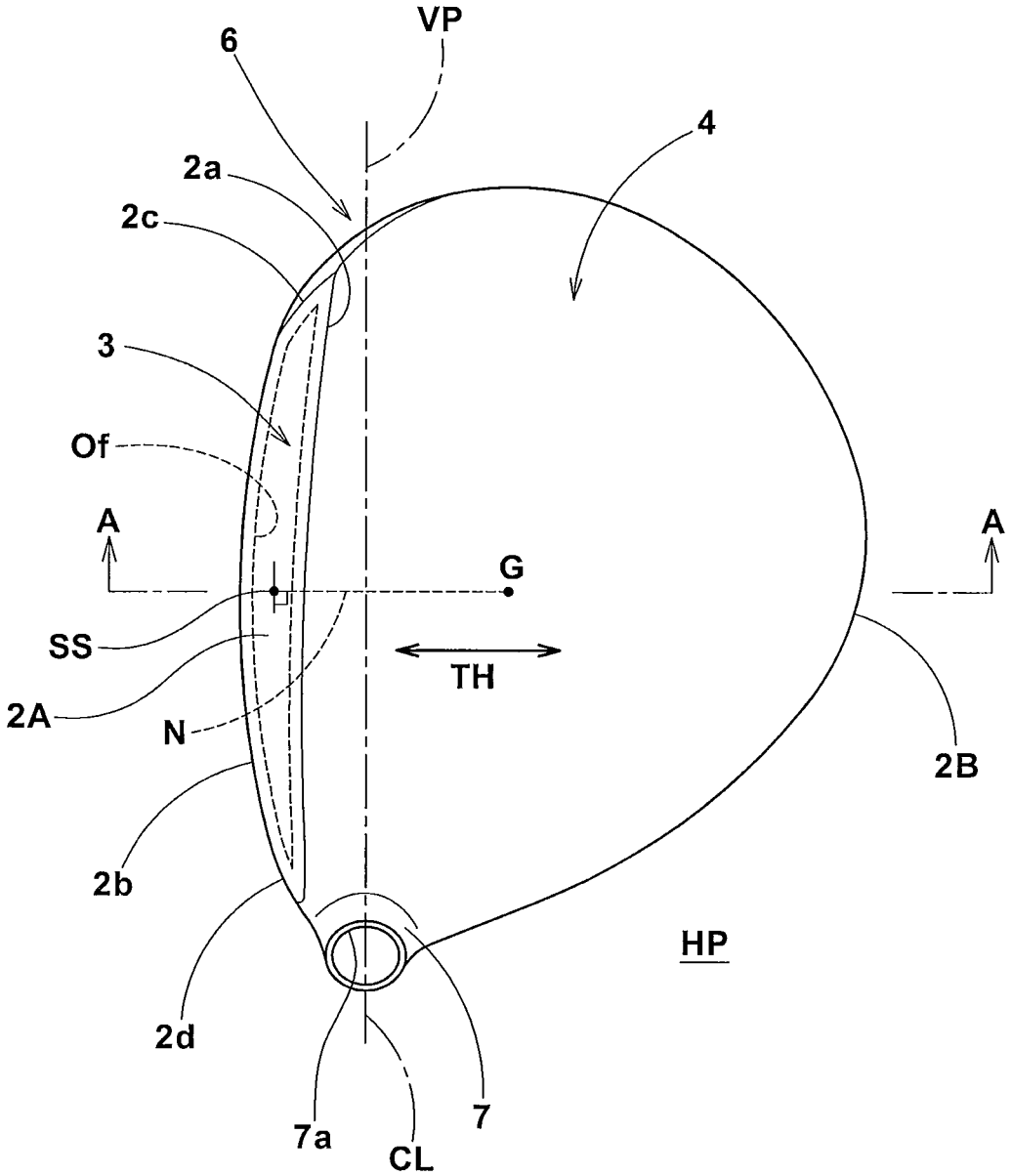
FIG. 1 is a plan view of a golf club head according to an embodiment of the present invention in its standard state.
Figure 2:
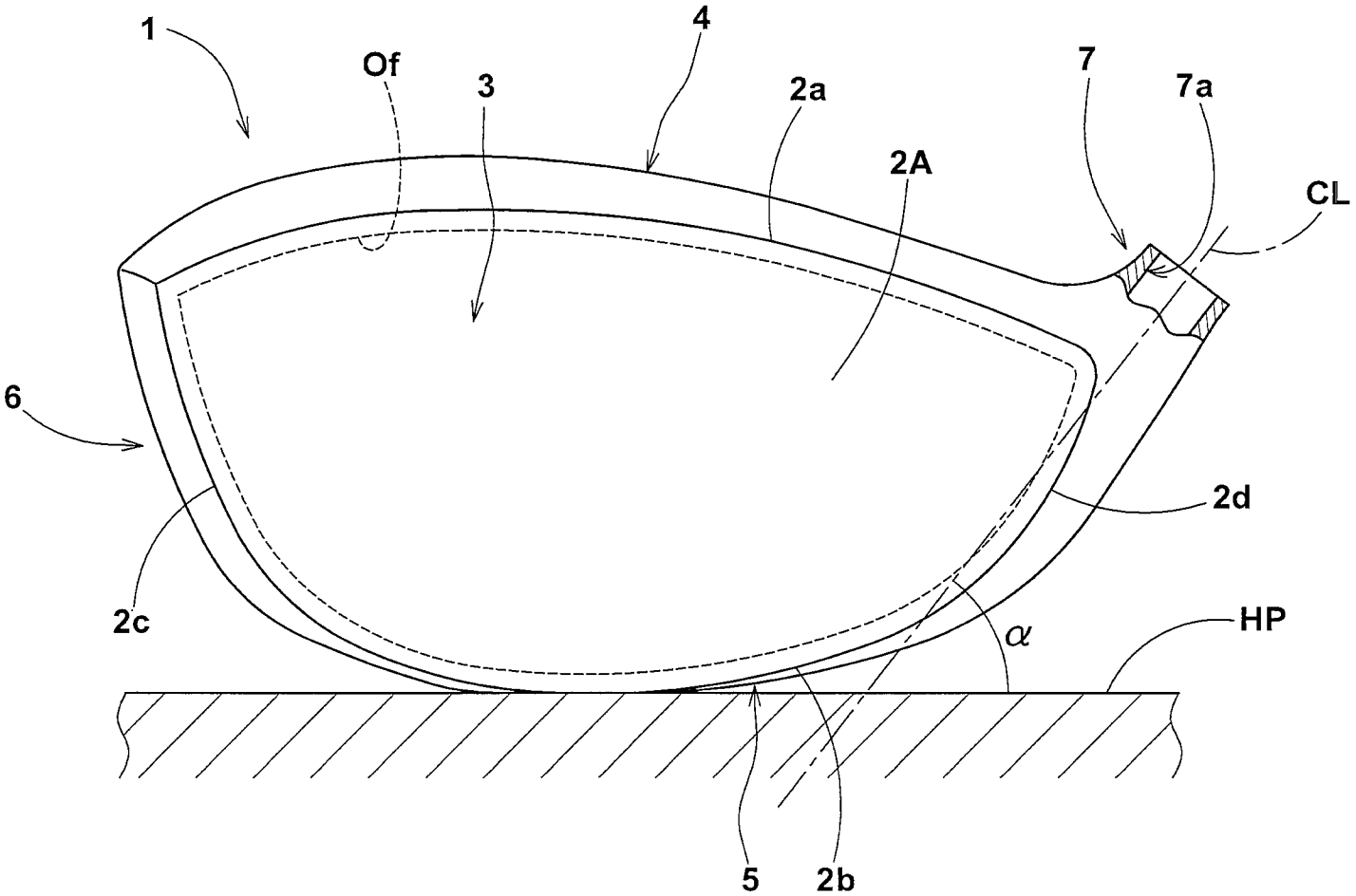
FIG. 2 is a front view thereof.

Embodiments of present invention will now be described in detail in conjunction with accompanying drawings.

In FIGS. 1-4, a golf club head 1 according to an embodiment of present invention is under its standard state.

Here, the standard state means a state of the club head which is set on a horizontal plane HP so that the axis CL of a club shaft (not shown) is placed within a vertical plane VP while inclining at a lie angle alpha specified for the head and the club face 2A at the sweet spot SS forms a loft angle beta specified for the head. In the case of the club head alone, the center line of the undermentioned shaft inserting hole 7*a* is used instead of the axis CL of the club shaft. The loft angle beta is more than 0 degrees. The club face angle is set at zero.

In this application including the description and claims, dimensions, positions, directions and the like relating to the club head refer to those under the standard state of the club head unless otherwise noted.

The undermentioned front-back direction TH of the head means a direction parallel with a straight line N projected on the horizontal plane HP, wherein the straight line N is drawn normally to the club face 2A passing through the center of gravity G of the club head.

The above-mentioned sweet spot SS corresponds to the intersecting point of the straight line N with the club face 2A.

The undermentioned heel-and-toe direction is a direction parallel with the horizontal plane HP and perpendicular to the front-back direction TH.

In the drawings, club head 1 according to the present invention has a face portion 3 whose front surface defines a club face 2A for hitting a ball, a crown portion 4 extending to an upper edge 2*a* of the face portion 3 and defining a top surface of the club head, a sole portion 5 extending to a lower edge 2*b* of the face portion 3 and defining a bottom surface of the club head, a side portion 6 connecting between the crown portion 4 and the sole portion 5 and extending from a toe-side edge 2*c* to a heel-side edge 2*d* of the face portion 3 through the back face 2B of the head, and a tubular hosel portion 7 positioned in a heel side of the crown portion 4 and having a shaft inserting hole 7*a* into which the tip end of a club shaft (not shown) is inserted. The club head 1 has a hollow structure with a hollow (i) enveloped by thin walls.

The present invention is suitably applied to wood-type golf club heads. Here, the term "wood-type" is meant for at least driver (#1 wood), brassie (#2 wood), spoon (#3 wood), baffy (#4-wood) and cleek (#5-wood) and further club heads having shapes similar to the foregoings.

The volume V of the club head 1 should not be limited especially. But, in view of easy golf swing, the volume V is preferably not less than 120 cc, more preferably not less than 130 cc. However, if the volume of the club head 1 becomes excessively large, then the weight of the club head is increased, and the swing balance is deteriorated, and there is a problem of violation of the golf rules and the like. Therefore, the volume V is preferably not more than 460 cc.

The mass of the club head 1 is preferably not less than 170 g, more preferably not less than 180 g, but not more than 240 g, more preferably not more than 230 g.

If less than 170 g, kinetic energy of the club head becomes small, and there is a tendency that the improvement in the ball flying distance can not be promised. If more than 240 g, it becomes difficult to swing through the golf ball, and there is a tendency that the directional stability and flying distance of the hit ball are deteriorated.

Figure 5:
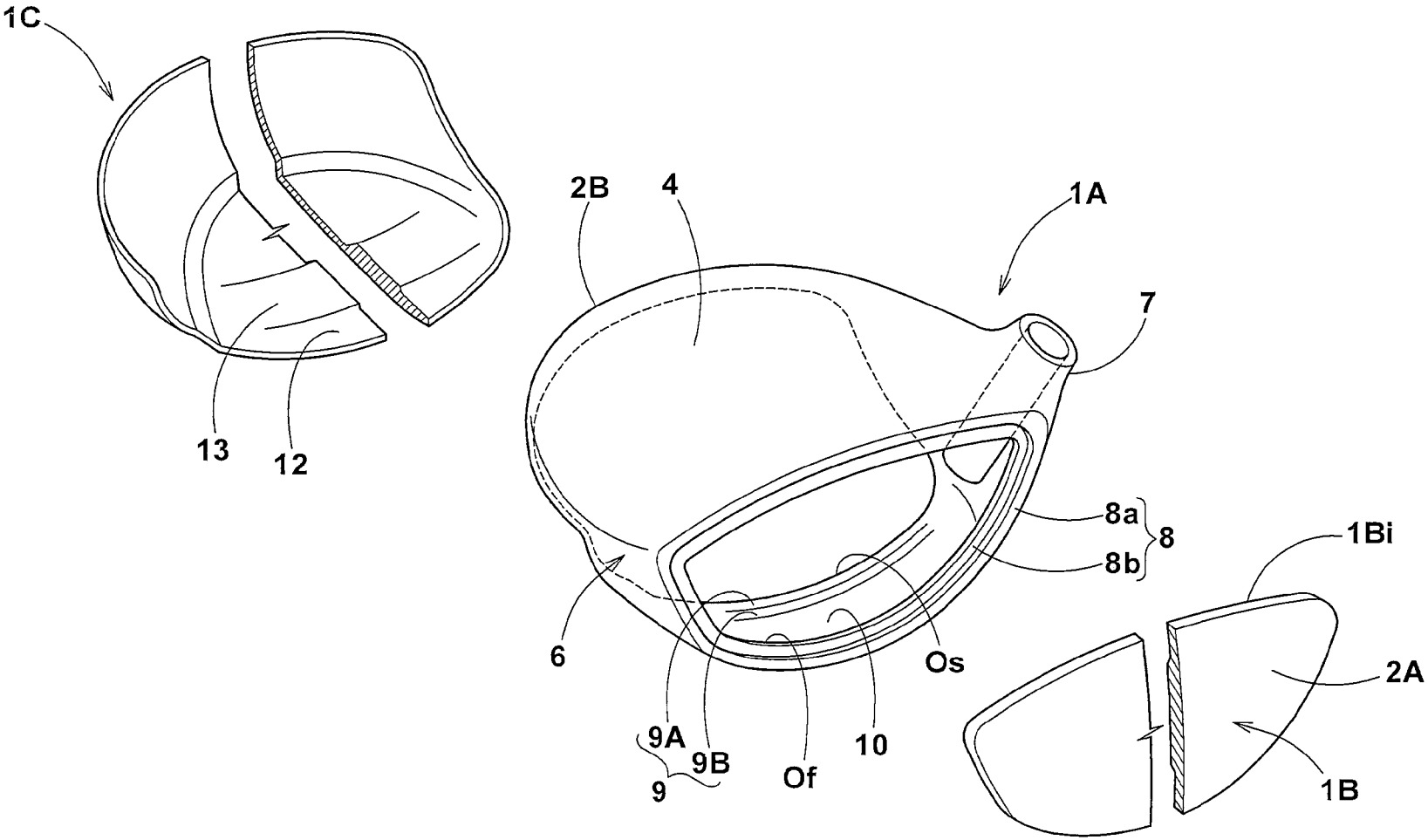
FIG. 5 is an exploded perspective view of the head shown in FIG. 1.

As shown in FIG. 5, the club head 1 in this embodiment comprises a main body member 1A provided with two independent openings: a face opening (Of) opened in the face portion 3 and a sole opening Os opened in its sole portion side, a face member 1B covering the face opening (Of), and a sole member 1C covering the sole opening Os.

The main body member 1A, face member 1B and sole member is in this embodiment are made of different metal materials suitable for their respective positions.

The specific gravity D1 of the main body member is larger than the specific gravity D2 of the face member but smaller than the specific gravity D3 of the sole member. (D3>D1>D2) Thereby, the center of gravity of the club head 1 is lowered, and the depth of the center of gravity is increased, and the directional stability and flying distance of the hit ball can be improved.

The face member 1B is fixed to the main body member by means of brazing or soldering so as to close the face opening (Of). The face member 1B includes the sweet spot SS of the club face. It is desirable that the face member 1B occupies at least 60% of the area of the club face 2A.

As to the metal material of the face member 1B, a titanium alloy having a large specific strength, e.g. Ti-15V-6Cr-4Al, Ti-6Al-4V and the like is preferably used.

Figure 4:
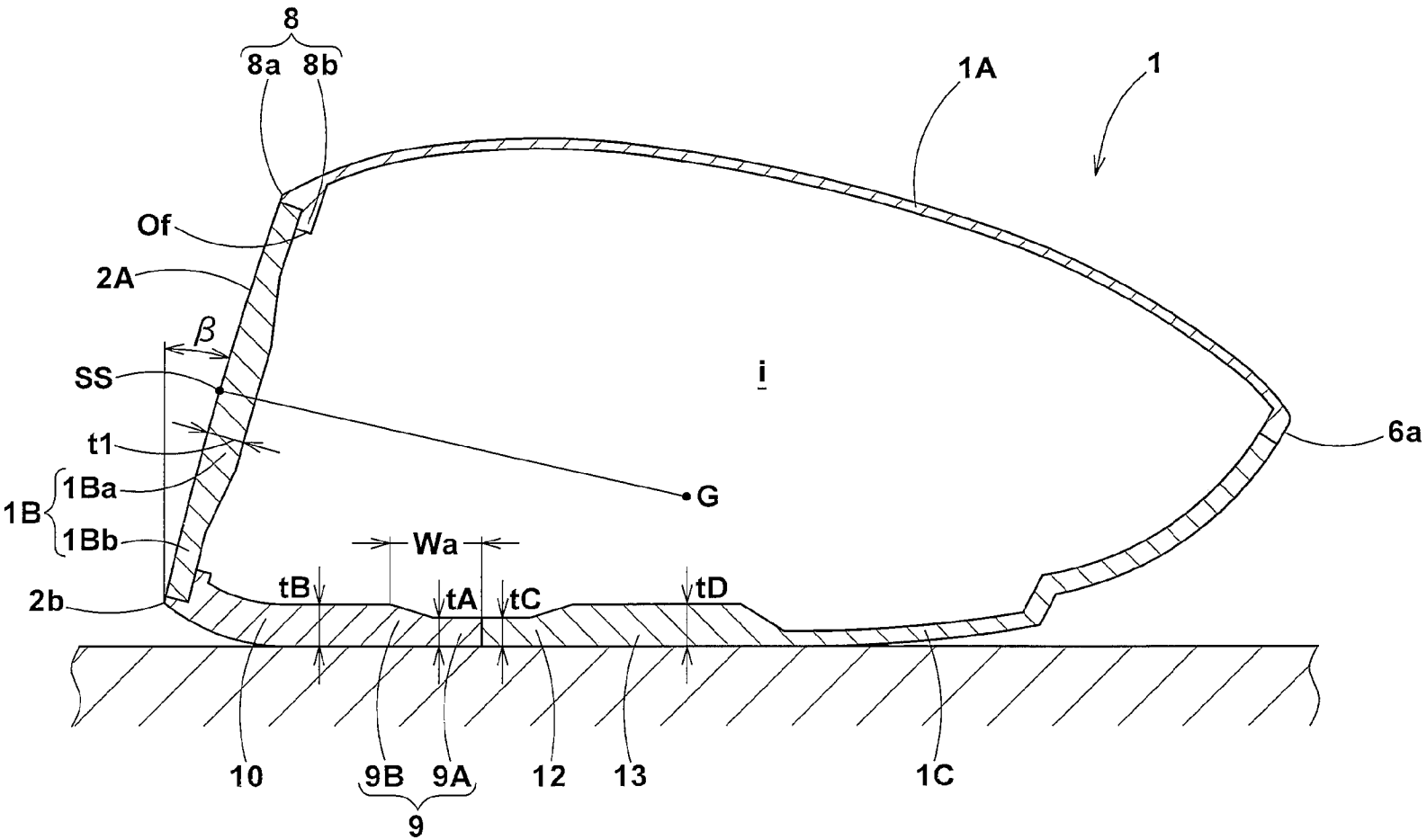
FIG. 4 is a cross sectional view of the head taken along line A-A of FIG. 1.

In this embodiment, as shown in FIG. 4, the face member 1B is a platy member having a thick central part 1Ba and a thin peripheral part 1Bb surrounding the thick central part 1Ba. The face portion 3 is formed by the face member 1B and a face edge part 8 surrounding the face opening (Of).

In order to balance between the durability of the face portion 3 and a weight reduction of the club head, the thickness t1 of the thick central part 1Ba is preferably not less than 1.5 mm, but not more than 4.0 mm.

In this specification, the thickness is measured in a state such that dents, e.g. grooves, punch marks and the like formed in the surface of the club face 2 or sole portion 5 are infilled.

In order to effectively bring out the above effect, the area of the face member 1B projected on the outer surface of the head (in this embodiment, equal to the area of the front surface of the platy face member) is preferably set in a range of not less than 16 sq·cm, more preferably not less than 17 sq·cm, but not more than 50 sq·cm, more preferably not more than 48 sq·cm.

The main body member 1A in this embodiment includes the crown portion 4, the hosel portion 7 and the face edge part 8.

The face opening (Of) in this embodiment is formed within the face portion 3. Thereby, the face edge part 8 is formed continuously and annularly around the face opening (Of).

The shape of the face opening (Of) should not be limited especially. But, preferred is a shape having a smooth contour substantially parallel to the contour of the edges 2*a*-2*d* of the face portion 3 like in this embodiment.

The face edge part 8 includes a main part 8*a* which forms a peripheral part of the front surface of the face portion in substance, and a receiving part 8*b* which dents steppedly from the outer surface of the main part 8*a* to support a peripheral part of the inner surface 1Bi of the face member 1B.

The receiving part 8*b* in this example is formed continuously and annularly around the face opening (Of).

Figure 3:
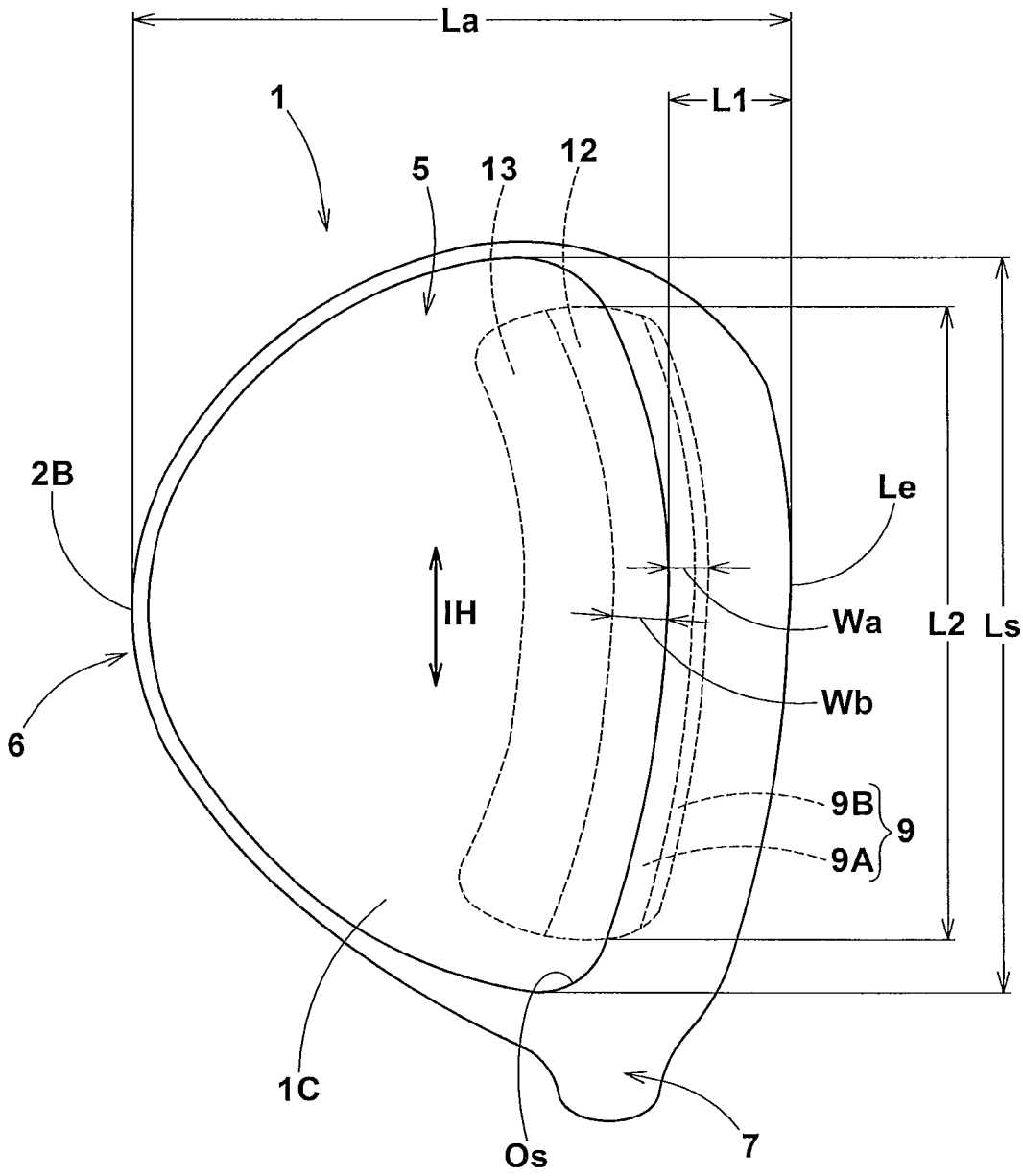
FIG. 3 is a bottom view thereof.

As shown in FIGS. 3-5, the sole opening Os is backwardly spaced apart from the lower edge 2*b* and extends from the sole portion 5 into the side portion 6. However, the sole opening Os should not be limited to such shape. It is possible to adopt the sole opening Os formed within the sole portion 5.

The main body member 1A further includes a front edge part 9 (hereinafter, sole opening's front edge part 9) which forms a part extending from a front part of the inner circumferential surface (or front edge) of the sole opening Os toward the face portion, and a heat blocking part 10 which forms a part between the sole opening's front edge part 9 and the face portion 3 and has a thickness larger than that of the sole opening's front edge part 9.

It is necessary that the thickness tA of the sole opening's front edge part 9 is not less than 0.5 mm and less than 2.5 mm. If the thickness tA is less than 0.5 mm, the durability of the club head 1 is deteriorated. If the thickness tA is 2.5 mm or more, the welding time increases, and the heat during welding transfers to the filler metal of the face member 1B, and the joint strength is decreased. For this reason, the thickness tA of the sole opening's front edge part 9 is preferably set in a range of not less than 0.7 mm, more preferably not less than 0.9 mm, but not more than 2.3 mm, more preferably not more than 2.1 mm.

Further, it is necessary that the thickness tB of the heat blocking part 10 is set in a range of from 2.5 to 10.0 mm. If the thickness tB is less than 2.5 mm, the strength of the club head 1 decreases and the heat capacity of the heat blocking part 10 decreases and the heat during welding easily transfers to the filler metal of the face member 1B. If the thickness tB exceeds 10.0 mm, it becomes difficult to work upon the main body member 1A and the production efficiency becomes worse, Further, the mass of the club head 1 increases and it becomes difficult to swing. For this reason, the thickness tB of the heat blocking part 10 is preferably not less than 2.7 mm, more preferably not less than 2.9 mm, but not more than 8.0 mm, more preferably not more than 7.7 mm.

In order to further effectively bring out the above effect, the thickness tB of the heat blocking part 10 is preferably set in a range of not less than 1.2 times, more preferably not less than 1.7 times, but not more than 8.0 times, more preferably not more than 6.0 times the thickness to of the sole opening's front edge part 9.

The sole opening's front edge part 9 in this embodiment is formed as a zone extending in the heel-and-toe direction with a substantially constant width Wa. If the width Wa of this thin part 9 is increased, the strength of the club head 1 decreases, and there is a possibility that the heat during welding is transferred more to the face portion and exerts an influence on the filler metal. If the width Wa is decreased, as the heat blocking part 10 expands instead, the mass of the club head increases, and there is a possibility that it becomes difficult to swing through the ball. For this reason, the width Wa measured perpendicularly to the longitudinal direction of the sole opening's front edge part 9 (or measured perpendicularly to the front edge of the sole opening) is preferably set in a range of not less than 5.0 mm, more preferably not less than 6.0 mm, but not more than 10.0 mm. more preferably not more than 9.0 mm.

In order to further bring out the above effect, it is preferable that the length L2 of the sole opening's front edge part 9 in the heel-and-toe direction IH is set in a range of from 70 to 90% of a maximum width Ls of the sole member 1C occurring in the heel-and-toe direction IH.

It is preferable that the sole opening's front edge part 9 is made up of an equal-thickness part 9A which has an equal thickness, and a progressively-increasing part 9B which is formed between the equal-thickness part 9A and the heat blocking part 10 and whose thickness gradually increases from the above-mentioned equal thickness to that of the heat blocking part 10.

Here, the thickness to of the sole opening's front edge part 9 is a thickness averaged over the width Wa.

Such progressively-increasing part 9B reduces the impact on the equal-thickness part 9A having a relatively small thickness and serves to increase the strength and durability.

As to the metal material forming the main body member 1A, it is desirable to use a material whose specific gravity is larger than that of the face member 1B. For example, stainless steel, maraging steel, titanium alloy or the like can be used preferably.

The main body member 1A can be manufactured by a technique of forging or casting, or a technique of bringing together two or more bent workpieces formed from a rolled metal or rolled metals. In order to improve the production efficiency, it is preferably formed as a single casting in which all parts are ready formed in one.

In order not to transfer the heat during welding the sole member 1C and main body member 1A to the face member 1B, and further in order to lower the center of gravity of the club head and to avoid an excessive increase in the mass of the club head, the shortest distance L1 measured in the front-back direction TH from the leading edge Le of the club head 1 (which may be the front end of the face portion under the standard state) to the sole opening Os (namely, the distance in the front-back direction between the leading edge Le and the front end of the sole member's front edge part 12) is preferably set in a range of not less than 15%, more preferably not less than 18%, but not more than 40%, more preferably not more than 35% of a club head length La which is a maximum length measured in the front-back direction TH between the leading edge Le and the backmost point of the club head.

The sole member 1C in this embodiment has a semi-cup shape resembling a cup which is cut off obliquely from back top to front bottom. The sole member 1C is fixed to the main body member 1A by brazing/soldering or welding (in this embodiment butt welding) so as to close the sole opening Os. Various welding techniques may be employed, but laser welding is preferred because it is possible to reduce the heat-affected zone.

As to the metal material forming the sole member 1C, a material having a specific gravity more than that of the main body member 1A is used to lower the center of gravity of the club head 1. Preferably, a tungsten alloy, e.g. W—Ni alloy and the like is used.

As shown in FIG. 5, the sole member 1C comprises a front edge part 12 (hereinafter sole member's front edge part 12) forming its club face side and connected to the sole opening's front edge part 9, and a sole reinforcing part 13 forming its back face side extending backward from the sole member's front edge part 12 and having a thickness more than that of the sole member's front edge part 12.

It is necessary that the thickness tC of the sole member's front edge part 12 is not less than 0.5 mm and less than 2.5 mm. If the thickness tC is less than 0.5 mm, the durability of the club head 1 is deteriorated. If the thickness tC is 2.5 mm or more, the welding time increases, and the heat during welding is transferred to the filler metal of the face member 1B, and the joint strength is decreased. For this reason, the thickness tC of the sole member's front edge part 12 is preferably set in a range of not less than 0.7 mm, more preferably not less than 0.9 mm, but not more than 2.3 mm, more preferably not more than 2.1 mm.

Further, it is necessary that the thickness tD of the sole reinforcing part 13 is set in a range of from 2.5 to 10.0 mm. If the thickness tD is less than 2.5 mm, the strength of the club head 1 decreases, and further it becomes difficult to lower the center of gravity and deepen the center of gravity. If the thickness tD exceeds 10.0 mm, the thickness excessively increases, and casting deformation is liable to increase, and the production efficiency is decreased. For this reason, the thickness tD of the sole reinforcing part 13 is preferably set in a range of not less than 2.7 mm, more preferably not less than 2.9 mm, but not more than 8.0 mm, more preferably not more than 7.7 mm.

It is preferable that the area Sf of the sole member's front edge part 12 projected on the outer surface of the club head is set in a range of from 10 to 30% of the area S2 of the sole member 1C projected on the outer surface of the club head. Such sole member's front edge part 12 helps to achieve both of the shortening of the welding time and the strength of the club face in a well balanced manner.

In order to bring out the above effect, the width Wb of the sole member's front edge part 12 measured perpendicularly to the longitudinal direction of the sole member's front edge part 12 (or measured perpendicularly to the front edge of the sole member) is preferably set in a range of not less than 6.0%, more preferably not less than 7.0%, but not more than 15.0%, more preferably not more than 12.0% of the club head length La.

The area S2 of the sole member 1C should not be limited especially. But, in order to lower the center of gravity of the club head and at the same time to avoid an excessive increase in the mass of the club head in a well balanced manner, the area S2 of the sole member 1C is preferably set in a range of not less than 40 sq·cm, more preferably not less than 43 sq·cm, but not more than 60 sq·cm, more preferably not more than 55 sq·cm.

As shown in FIG. 3, the sole member's front edge part 12 in this embodiment is formed as a zone extending along the front edge of the sole member 1C with a constant width. However, the sole member's front edge part 12 should not be limited to such shape. Various shapes may be employed.

A method for manufacturing the club head 1 constructed as explained above will be described hereunder.

In this embodiment, firstly, a process for preparing the main body member 1A, face member 1B and sole member 1C is carried out. Each member 1A-1C may be manufactured by various methods for example casting, forging, press forming and the like.

Next, carried out is a face member fixing process in which the face member 1B is fixed to the main body member 1A by brazing/soldering so as to close the face opening (Of).

In the face member fixing process, a filler metal for example in paste form is applied to the inside and the outside of the club head at the positions corresponding to the joint between the face member 1B and the main body member 1A and the filler metal is heated. This allows the filler metal to penetrate into a space between the face member 1B and the main body member 1A and solidify to fix the face member 1B to the main body member 1A. By utilizing the sole opening Os, the filler metal can be easily applied to the inside of the club head 1.

After the face member fixing process, a sole member fixing process in which the sole member 1C is welded to the main body member 1A so as to close the sole opening Os, is carried out. In this process, a welding method capable of providing an energy at a very high energy density such as laser welding for example utilizing carbon dioxide gas laser is preferably employed. Thereby, it becomes possible to weld in a small amount of time and prevent heat deformation of the filler metal, therefore, the durability of the face portion is improved.

As has been explained, the club head 1 in this embodiment is manufactured.

While a preferred embodiment has been described, variations thereto will occur to those skilled in the art within the scope of the present inventive concepts which are delineated by the following claims.

Figure 6:
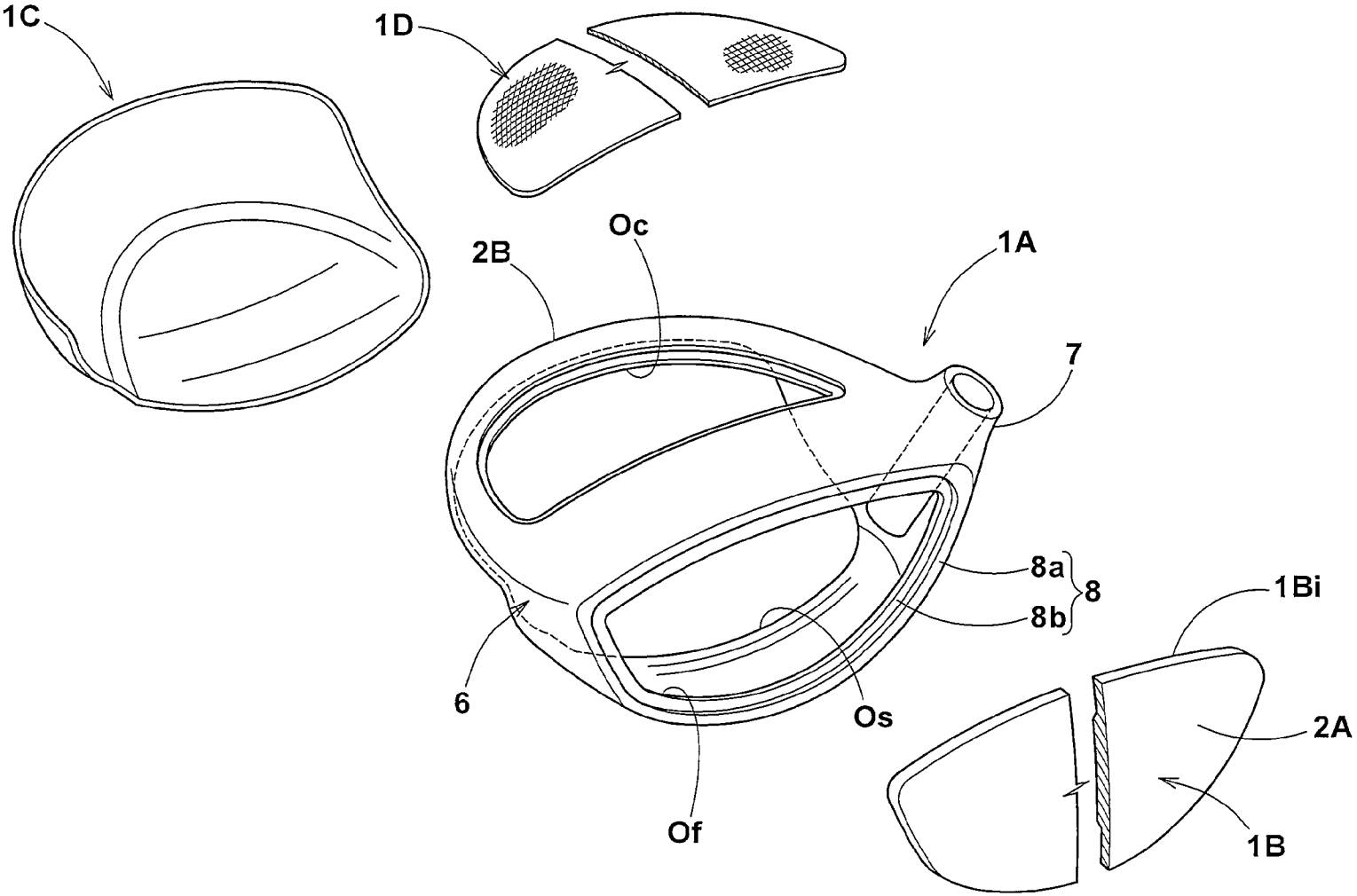
FIG. 6 is an exploded perspective view of a golf club head according to another embodiment of the present invention.
Figure 7:
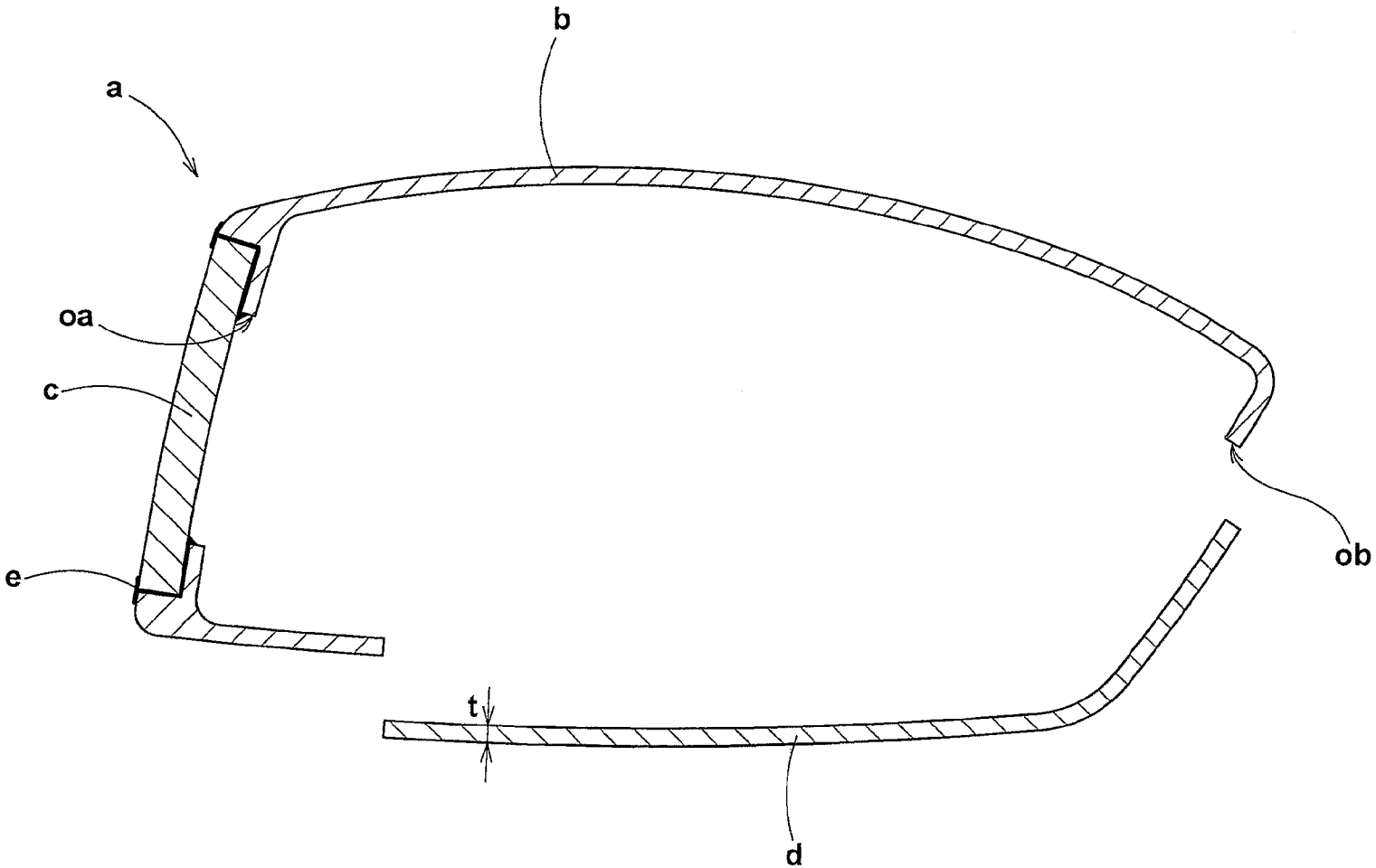
FIG.7 PRIOR ART
FIG. 7 is a cross sectional view of a conventional golf club head.

For example, as shown in FIG. 6, the club head 1 may have a hollow structure made up of a main body member 1A provided with three independent openings:

the above-mentioned face opening (Of) and sole opening Os and further a crown opening Oc opened in its crown portion side, the face member 1B closing the face opening (Of), the sole member 1C closing the sole opening Os, and a crown member 1D closing the crown opening Oc.

In such club head 1, it is possible to braze/solder the face member 1B by utilizing the sole opening Os and crown opening Oc, therefore, it is possible to manufacture the club head 1 more efficiently.

The crown member 1D can be formed as a thin platy member made of a fiber reinforced plastic for example.

Comparison Tests

In order to confirm the effects of the present invention, wood-type golf club heads (cleek, volume: 155 cc, loft: 18 degrees, Lie: 59 degrees) were experimentally manufactured based on the structure shown in FIGS. 1 to 5 and tested for the durability of the club face.

Specifications of the heads were identical except for those shown in Table 1.

common main specifications are as follows:

Main body member: stainless steel (specific gravity 7.8)

Sole member: W—Ni alloy (specific gravity 8.25)

Face member: Ti alloy (specific gravity 4.45)

average thickness: 2.5 mm

<Durability Test>

The club heads were attached to identical FRP shafts ("MP600" manufactured by SRI sports Limited, flex R) and 42-inch #5-wood clubs were made. Each club was mounted on a swing robot manufactured by Miyamae Co. Ltd. and hit golf balls repeatedly at the sweet spot of the club face at a head speed of 47 m/s. The number of hits achieved without causing any damage in the joint between the face member and main body member was counted. The results are shown in Table 1. The acceptable level is 3000 or more hits.

<Measurement of Mass of Club Head>

The mass of each club head was measured. The results are shown in Table 1. If the mass is excessively large, the club becomes difficult to swing, therefore, it is not preferable.

From the test results, it was confirmed that, in comparison with the club heads as comparative examples, the club heads according to the present invention were improved in the durability without excessively increasing the mass of the club head.

TABLE 1

| Head | Ref. 1 | Ex. 1 | Ex. 2 | Ex. 3 | Ex. 4 | Ref. 2 | Ref. 3 | Ex. 5 |
|---|---|---|---|---|---|---|---|---|
| Thickness tA of sole opening's front edge part (mm) | 0.4 | 0.5 | 2.0 | 3.0 | 3.4 | 3.5 | 2.0 | 2.0 |
| Thickness tB of heat blocking part (mm) | 3.5 | 3.5 | 3.5 | 3.5 | 3.5 | 3.5 | 2.4 | 2.5 |
| Ratio tB/tA | 8.75 | 7.0 | 1.75 | 1.17 | 1.03 | 1.0 | 1.2 | 1.25 |
| Ratio L1/La of shortest distance L1 and club head length La (%) | 25 | 25 | 25 | 25 | 25 | 25 | 25 | 25 |
| Ratio L2/Ls of length L2 and sole member maximum width(%) | 80 | 80 | 80 | 80 | 80 | 80 | 80 | 80 |
| Sole opening's front edge part width Wa (mm) | 80 | 80 | 80 | 80 | 80 | 80 | 80 | 80 |
| Durability [hit count] | 2561 | 3540 | 9235 | 8230 | 7974 | 2843 | 2548 | 4756 |
| Mass of club head (g) | 205 | 210 | 220 | 228 | 235 | 236 | 205 | 210 |

| Head | Ex. 6 | Ex. 7 | Ex. 8 | Ref. 4 | Ex. 9 | Ex. 10 | Ex. 11 | Ex. 12 |
|---|---|---|---|---|---|---|---|---|
| Thickness tA of sole opening's front edge part (mm) | 2.0 | 2.0 | 2.0 | 2.0 | 2.0 | 2.0 | 2.0 | 2.0 |
| Thickness tB of heat blocking part (mm) | 2.7 | 7.7 | 10.0 | 10.5 | 3.5 | 3.5 | 3.5 | 3.5 |
| Ratio tB/tA | 1.35 | 3.85 | 5.0 | 5.25 | 1.75 | 1.75 | 1.75 | 1.75 |
| Ratio L1/La of shortest distance L1 and club head length La (%) | 25 | 25 | 25 | 25 | 10 | 18 | 35 | 50 |
| Ratio L2/Ls of length L2 and sole member maximum width(%) | 80 | 80 | 80 | 80 | 80 | 80 | 80 | 80 |
| Sole opening's front edge part width Wa (mm) | 80 | 80 | 80 | 80 | 8 | 8 | 8 | 8 |
| Durability [hit count] | 5272 | 9597 | 9665 | 9891 | 3050 | 4151 | 8258 | 8162 |
| Mass of club head (g) | 212 | 238 | 240 | 243 | 223 | 221 | 218 | 210 |

| Head | Ex. 13 | Ex. 14 | Ex. 15 | Ex. 16 | Ex. 17 | Ex. 18 | Ex. 19 | Ex. 20 |
|---|---|---|---|---|---|---|---|---|
| Thickness tA of sole opening's front edge part (mm) | 2.0 | 2.0 | 2.0 | 2.0 | 2.0 | 2.0 | 2.0 | 2.0 |
| Thickness tB of heat blocking part (mm) | 3.5 | 3.5 | 3.5 | 3.5 | 3.5 | 3.5 | 3.5 | 3.5 |
| Ratio tB/tA | 1.75 | 1.75 | 1.75 | 1.75 | 1.75 | 1.75 | 1.75 | 1.75 |
| Ratio L1/La of shortest distance L1 and club head length La (%) | 25 | 25 | 25 | 25 | 25 | 25 | 25 | 25 |
| Ratio L2/Ls of length L2 and sole member maximum width(%) | 60 | 75 | 85 | 95 | 80 | 80 | 80 | 80 |
| Sole opening's front edge part width Wa (mm) | 8 | 8 | 8 | 8 | 4 | 6 | 9 | 15 |
| Durability [hit count] | 7125 | 8003 | 8250 | 6532 | 9807 | 9524 | 6585 | 4228 |
| Mass of club head (g) | 205 | 217 | 223 | 228 | 225 | 226 | 228 | 231 |

club head length La: maximum distance in front-back direction between leading edge Le and backmost point of club head.
shortest distance L1: shortest distance in front-back direction between leading edge Le and sole opening Os
length L2: length of sole opening's front edge part in heel-and-toe direction

REFERENCE SIGNS LIST

1 golf club head
1A main body member
1B face member
1C sole member
2A club face
2B back face
3 face portion
5 sole portion
Of face opening
Os sole opening
9 sole opening's front edge part
10 heat blocking part
12 sole member's front edge part
13 sole reinforcing part

The invention claimed is:

1. A golf club head having a hollow structure and having a face portion provided in its front surface with a club face for hitting a ball and a sole portion extending to a lower edge of the face portion and forming a bottom surface of the head, wherein the golf club head is composed of a main body member separately provided with a face opening opened in the face portion and a sole opening opened in its sole portion side, a face member fixed to the main body member by brazing or soldering so as to close the face opening, and a sole member fixed to the main body member by brazing, soldering or welding so as to close the sole opening, said main body member comprises a sole opening's front edge part forming a part extending from a front edge of the sole opening toward the face portion, and a heat blocking part forming a part between the sole opening's front edge part and the face portion and having a thickness larger than a thickness of the sole opening's front edge part, said sole member comprises a sole member's front edge part connected to the sole opening's front edge part and forming a face-side part of the sole member, and a sole reinforcing part forming a part extending from the sole member's front edge part toward the back side of the head and having a thickness larger than a thickness of the sole member's front edge part, the thickness of the sole member's front edge part and the thickness of the sole opening's front edge part are not less than 0.5 mm and less than 2.5 mm, and the thickness of the sole reinforcing part and the thickness of the heat blocking part are 2.5 to 10.0 mm.

2. The golf club head according to claim 1, wherein the width of the sole opening's front edge part measured perpendicularly to a longitudinal direction of the sole opening's front edge part is 5.0 to 10.0 mm.

3. The golf club head according to claim 2, wherein the thickness of the heat blocking part is 1.2 to 8.0 times the thickness of the sole opening's front edge part.

4. The golf club head according to claim 3, wherein an area of the sole member's front edge part projected on the outer surface of the club head is 10 to 30% of an area of the sole member projected on the outer surface of the club head.

5. The golf club head according to claim 3, wherein the specific gravity D1 of the main body member, the specific gravity D2 of the face member and the specific gravity D3 of the sole member satisfy the following condition D3>D1>D2.

6. The golf club head according to claim 2, wherein an area of the sole member's front edge part projected on the outer surface of the club head is 10 to 30% of an area of the sole member projected on the outer surface of the club head.

7. The golf club head according to claim 6, wherein the specific gravity D1 of the main body member, the specific gravity D2 of the face member and the specific gravity D3 of the sole member satisfy the following condition D3>D1>D2.

8. The golf club head according to claim 2, wherein a length of the sole opening's front edge part measured in a heel-and-toe direction of the head is in a range of from 70 to 90% of a maximum width of the sole member occurring in the heel-and-toe direction.

9. The golf club head according to claim 8, wherein a length of the heat blocking part measured in the heel-and-toe direction is more than said length of the sole opening's front edge part.

10. The golf club head according to claim 8, wherein a length of the sole member's front edge part measured in the heel-and-toe direction is substantially equal to said length of the sole opening's front edge part.

11. The golf club head according to claim 10, wherein a length of the sole reinforcing part measured in the heel-and-toe direction is substantially equal to said length of the sole member's front edge part.

12. The golf club head according to claim 10, wherein said front edge of the sole opening is curved describing an arc convex toward the face portion, and the sole opening's front edge part, the sole member's front edge part and the sole reinforcing part are also curved therealong.

13. The golf club head according to claim 2, wherein the specific gravity D1 of the main body member, the specific gravity D2 of the face member and the specific gravity D3 of the sole member satisfy the following condition D3>D1>D2.

14. The golf club head according to claim 1, wherein the thickness of the heat blocking part is 1.2 to 8.0 times the thickness of the sole opening's front edge part.

15. The golf club head according to claim 14, wherein an area of the sole member's front edge part projected on the outer surface of the club head is 10 to 30% of an area of the sole member projected on the outer surface of the club head.

16. The golf club head according to claim 15, wherein the specific gravity D1 of the main body member, the specific gravity D2 of the face member and the specific gravity D3 of the sole member satisfy the following condition D3>D1>D2.

17. The golf club head according to claim 14, wherein the specific gravity D1 of the main body member, the specific gravity D2 of the face member and the specific gravity D3 of the sole member satisfy the following condition D3>D1>D2.

18. The golf club head according to claim 1, wherein an area of the sole member's front edge part projected on the outer surface of the club head is 10 to 30% of an area of the sole member projected on the outer surface of the club head.

19. The golf club head according to claim 18, wherein the specific gravity D1 of the main body member, the specific gravity D2 of the face member and the specific gravity D3 of the sole member satisfy the following condition D3>D1>D2.

20. The golf club head according to claim 1, wherein the specific gravity D1 of the main body member, the specific gravity D2 of the face member and the specific gravity D3 of the sole member satisfy the following condition D3>D1>D2.

* * * * *